US005335808A

United States Patent [19]

Lee

[11] Patent Number: 5,335,808

[45] Date of Patent: Aug. 9, 1994

[54] EASY OPENING POP-TOP CAN LID

[76] Inventor: Robert W. Lee, 515 Vista Del Campo, Camarillo, Calif. 93010

[21] Appl. No.: 103,367

[22] Filed: Aug. 9, 1993

[51] Int. Cl.[5] ..... B65D 17/34

[52] U.S. Cl. ..... 220/269; 220/270; 220/380

[58] Field of Search ..... 220/269, 270, 268, 380

[56] References Cited

U.S. PATENT DOCUMENTS

| | | | |
|---|---|---|---|
| 3,977,561 | 8/1976 | Strobe et al. | 220/269 |
| 4,039,100 | 8/1977 | Wells | 220/269 |
| 4,051,976 | 10/1977 | Perry | 220/269 |
| 4,333,581 | 6/1982 | Flansburg | 220/269 X |
| 4,463,866 | 8/1984 | Mandel | 220/269 |
| 4,480,763 | 11/1984 | Schneider | 220/269 |

*Primary Examiner*—Allan N. Shoap
*Assistant Examiner*—Vanessa Caretto
*Attorney, Agent, or Firm*—John J. Posta, Jr.

[57] ABSTRACT

A pop-top can lid is easier to open than conventional lids, and includes a generally horizontally extending can cover plate having a peripheral rim. It also has a scored area medial of the rim. An elongated generally horizontally extending lift tab is pivotally secured to the upper surface of the plate at a pivot point medial of the rim by a rivet or the like. The tab is divided into an elongated lift arm with finger-receiving opening on one side of the rivet and a shorter drive arm on the opposite side of the rivet. The drive arm is directly over the medial portion of the scored area. A bubble integral with the plate extends upwardly therefrom in the scored area and is capable of being inverted by downward finger pressure. Then the drive arm is able to be easily rotated down thereinto, thus automatically raising the lift arm well above the plate surface so that it can easily be grasped by the fingers. The lift arm can then be rotated upwardly to force the drive arm down to break the plate at the score line to fold the scored area down into the can to form a pour opening for the can. Preferably, the raised bubble biases the drive arm up and the lift arm down so that the tab does not rattle, and the lift arm is against the upper surface of the plate, for easier stacking of a plurality of the lids together.

6 Claims, 1 Drawing Sheet

EASY OPENING POP-TOP CAN LID

BACKGROUND OF THE INVENTION

1. Field of the Invention

The present invention generally relates to cover means and more particularly to an improved pop-top can lid which is easy to make, stack and open.

2. Prior Art

So-called pop-top can lids are used very extensively on beverage containers for soft drinks, beer and the like. Each can generally includes a generally circular (in plan view) metal top cover plate, to the upper surface of which is secured a lift tab, one end of which is positioned over a scored area in the plate. When the tab is lifted at one end, the opposite end positioned over the scored area is rotated downwardly to break the scoring and open the lid for easy removal of fluid from the can to which the lid is attached.

Unfortunately, each such conventional lid has the same major problem. Thus, the lift tab is flat and tight against the upper surface of the lid. Moreover, it is held thereagainst with considerable force to prevent the tab from rattling on the lid. A fingernail must be forced between the lift tab and lid and then the lift tab must be pried up by the fingernail before it can be moved up above the lid surface sufficiently far to enable the fingers of the hand to grasp it and raise it further. This prying up is resisted because the drive end of the tab immediately engages the can lid in the scored area as the prying takes place. Considerable force must be exerted by the fingernail in order to pry the tab up far enough to enable the fingers to take over the task while the scoring is being broken. During such initial prying it is quite common for the fingernail to break. This is particularly distressing in the case of girls and women with manicured natural and artificial fingernails.

Accordingly, such devices as fork tines, knife blades, screw drivers, nail files and the like are frequently used to carry out the initial prying operation. Certain tools also have been fabricated and sold which slip over the tabs and help the prying operation. But there are many occasions when external aids such as those mentioned above are not available, and the prying and lid opening must therefore be done solely with the fingernails and fingers.

Therefore, it would be desirable to be able to provide an improved, easier opening pop-top can lid which would not require the use of the fingernails or external tools to initially pry up the lift tab on the lid. The can lid should be inexpensive to make and efficient to use. Moreover, a plurality of the lids should be easily stackable on each other for compact shipment and for the compatability with the lidding machinery before and during assembly with the container can bodies.

SUMMARY OF THE PRESENT INVENTION

The improved, easy opening pop-top can lid of the present invention satisfies all the foregoing needs. The lid is simple and inexpensive to make and to use, efficiently seals a can and yet is very easy to open without the use of fingernails or external tools.

The can lid is substantially as set forth in the Abstract of the Disclosure. Thus, the can lid includes a preferably generally horizontal can cover of metal, plastic or the like, preferably having a peripheral rim which usually is generally circular in plan view. The lid includes a scored area medial of the rim, which scored area can be broken into and folded down to provide an opening to a can to which the lid is affixed.

The can lid also includes an elongated, preferably generally horizontal lift tab of metal, plastic or the like pivotally connected to the upper surface of the lid medial of the rim by a rivet or the like. The tab is divided by the combination of the rivet and lift tab shape into a long lift arm and a shorter drive arm on opposite sides of the pivot line, which is approximately adjacent to the rivet. The drive arm is positioned over the medial portion of the score area and directly above a raised convex surface integral with the lid and within the score area.

Preferably, the convex surface biases the drive arm up and the connected lift arm down towards the upper surface of the lid. This makes the lid compact for stacking and prevents the tab from rattling. Also preferably, the drive arm is not in the same plane as the lift arm but is angled slightly upwardly therefrom.

The convex surface and the drive arm are readily depressed by finger pressure. This then causes the drive arm to be rotated down into the inverted convex surface so as to simultaneously raise the lift arm far enough above the lid surface to enable it to be easily grasped by the fingers. When the lift arm is then raised further by the fingers, the drive arm is forced down at an efficient angle against the area of the lid defined by the score line or lines so that the latter is broken open and folded down, thus opening the lid for pouring out of the material contained in a can to which the lid is affixed.

Further features of the improved easy opening pop-top can lid of the present invention are set forth in the following detailed description and accompanying drawings.

DRAWINGS

Figure 5:
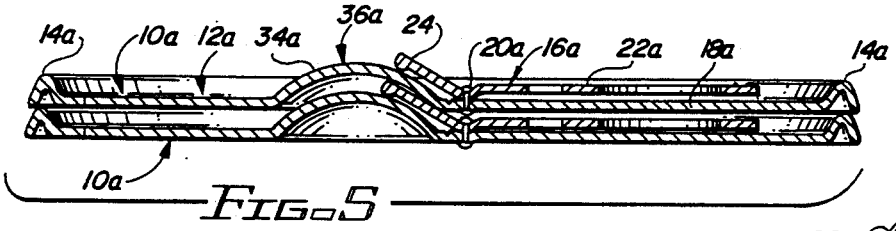
Figure 6:
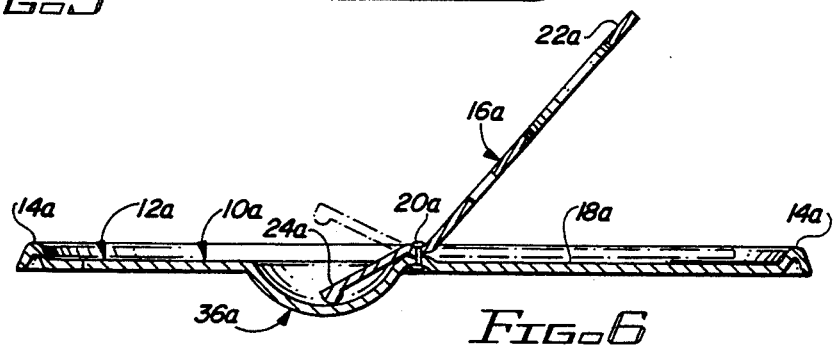

FIG. 5 is an enlarged schematic vertical cross-section of a second preferred embodiment of the improved easy opening pop-top can lid of the present invention, a pair of said lids being shown in closely stacked relation; and, FIG. 6 is an enlarged schematic vertical cross-section of one of the lids of FIG. 5, showing the convex surface thereof inverted and the drive arm and lift arm thereof in a position immediately preceding that necessary for opening of the lid.

DETAILED DESCRIPTION

FIGS. 1–4

Now referring more particularly to FIGS. 1–4 of the drawings, a first preferred embodiment of the improved, easy opening pop-top can lid of the present invention is schematically set forth therein.

Thus, can lid 10 is shown, which comprises a generally horizontally extending can cover plate 12 of metal, plastic or the like, having an approximately circular configuration (in plan view) with a raised peripheral rim 14. An elongated, generally horizontally extending lift tab 16 of metal, plastic or the like, is pivotally secured over the upper surface 18 of plate 12 by a generally vertical rivet 20 or the like of metal or plastic passing down through lift tab 16 and plate 12, so that tab 16 is held tightly against surface 18.

Rivet 20 approximately divides the "one piece" lift tab 16 into two portions, an elongated lift arm 22 and a shorter drive arm 24. Lift arm 22 preferably defines a finger hole 26 adjacent the free end 28 thereof. Drive arm 24 preferably includes a striker or point 30 which is located at the free end 32 thereof.

Figure 2:
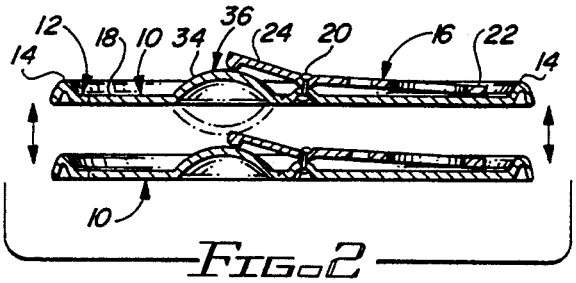
FIG. 2 is a schematic vertical cross-section, taken along the section line 2—2 of FIG. 1, showing a pair of the lids of FIG. 1 disposed one above the other in a stackable relation.
Figure 3:
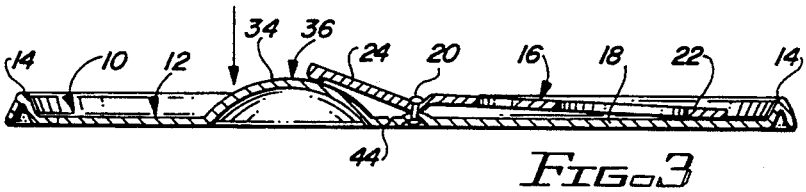
FIG. 3 is an enlarged schematic cross-section of the lid of FIG. 1, taken along the section line 2—2 of FIG. 1.
Figure 4:
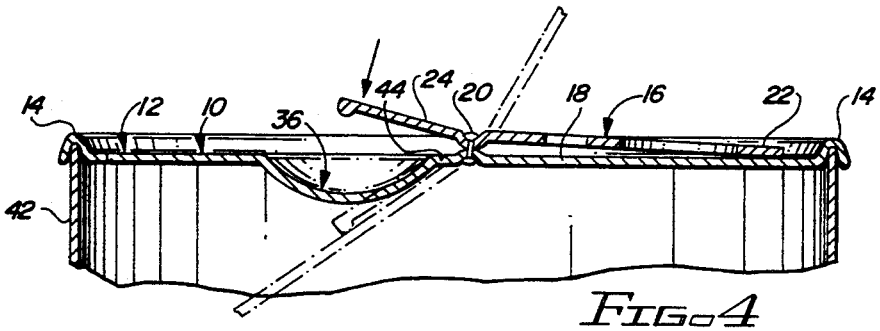
FIG. 4 is an enlarged schematic cross-section of the lid of FIG. 3, showing the lid with the bubble thereof inverted and showing in dotted outline the position of the drive arm and lift arm when the lift tab is used to open the lid.

As can be seen in FIGS. 2–4, although lift arm 22 lies about horizontally, drive arm 24 is canted up at a slight angle therefrom and rests tightly against the upper surface 34 of a raised convex surface 36 which is an integral part of the portion of plate 12 which is medial to rim 14. Convex surface 36 is finger-depressible but still holds arm 24 sufficiently tightly to prevent tab 16 from rattling on plate 12 and also forces arm 22 to lie snugly against upper surface 18 of plate 12.

Figure 1:
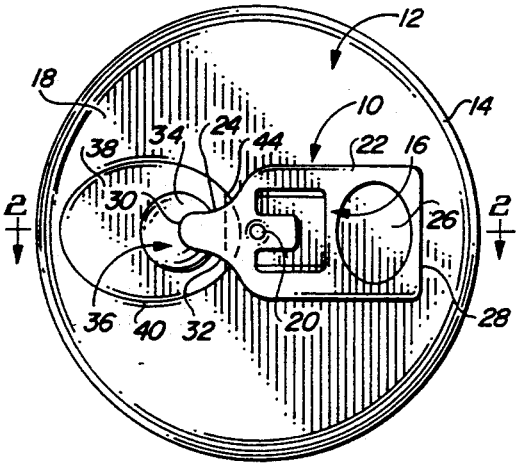
FIG. 1 is a schematic top plan view, partly broken away, of a first preferred embodiment of the improved easy opening pop-top can lid of the present invention.

Preferably, lift tab 16 is aligned along the centerline of plate 12, as shown in FIG. 1. So also is an oval area 38 of cover plate 12 defined by an oval score line 40. Area 38 encompasses convex surface 36 and runs under drive arm 24.

When it is desired to open a can 42 (FIG. 4) to which lid 10 is attached as a top cover, in order to remove the contents, such as a soft drink, therefrom, convex surface 36 and drive arm 24 are depressed by a finger to the inverted position shown in FIG. 4. This simultaneously lifts the opposite end of tab 16 well above plate 12, as indicated by the dotted outline in FIG. 4, so that arm 22 can be easily grasped by one or more fingers, whether or not finger hole 26 is used.

Lift tab 16 can then be easily lifted further, being in a mechanically efficient position for rotating striker 30 down hard against the convex surface 36 and forcing the rupture of plate 12 at score line 40. As plate 12 so ruptures, area 38 folds down below the level of plate 12 into can 42 along a fold line 44 adjacent rivet 20 to provide the necessary pour opening for can 42. All this is accomplished easily and simply and without having to force either a fingernail or a tool between the underside of arm 22 and the adjacent portion of surface 18 of plate 12 in order to initiate the can opening procedure.

Can lid 10 not only is easily opened without nail damage and without the use of a separate tool or excessive force, but it also has the advantage of being easily and inexpensively manufactured and being capable of being easily closely stacked with a plurality of similar lids 10 (FIG. 2) for safer, more compact shipping and storage and assembly.

FIGS. 5 and 6.

A second preferred embodiment of the improved easy opening pop-top can lid of the present invention is schematically depicted in FIGS. 5 and 6 of the drawings. Thus, cover lid **10*a* is shown. Components thereof identical to those of lid 10** bear the same numerals but are succeeded by the letter "a".

Lid **10*a* differs from lid 10** only in the following respects:

a) drive arm **24*a* lies closely against the adjacent surface of convex surface 36*a*, which convex surface contour is slightly flatter than that of convex surface 36** in order to facilitate this close contact;

b) drive arm **24*a* lies in a resting position which is at a greater angle of inclination with respect to lift arm 22*a* than the angle of inclination seen between arm 24 and arm 22**;

c) lift arm **22*a* lies parallel to upper surface 18*a* of plate 12*a*, but not necessarily in full contact therewith. However, there is sufficient frictional contact between drive arm 24*a* and convex surface 36*a* to prevent rattling of lift tab 16*a* on cover plate 12*a*; and, d) drive arm 24*a* is relatively shorter than drive arm 24 in order to assure maximam compactness in stacking a plurality of lids 10*a* together, as shown in FIG. 5**.

Lid **10*a* has the other advantages of lid 10** and can be fabricated of similar materials in an inexpensive, single operation.

It will be understood that the relative proportions and configurations of the components of the improved easy opening pop-top can lid of the present invention can be varied, as desired, to suit individual requirements. For example, the cover plate can be square, oval, rectangular, or of another configuration in plan view and with or without a raised rim. Moreover, a striker need not be present on the drive arm, nor need there be a finger hole on the lift arm.

Various other modifications, changes, alterations and additions can be made in the improved easy opening pop-top can lid of the present invention, its components and their parameters. All such modifications, changes, alterations and additions as are within the scope of the appended claims form part of the present invention.

What is claimed is:

1. An improved, easy-opening pop-top can lid, said lid comprising, in combination:

a) a generally horizontally extending can cover plate having an upper surface, a peripheral rim and a scored area medial of said rim;

b) an elongated, generally horizontally extending lift tab pivotally secured to the upper surface of said plate at a pivot point medial of said rim, said lift tab having a lift arm on one side of said pivot point and a drive arm on the opposite side of said pivot point, said tab being aligned with said scored area whereby said drive arm is approximately directly over said scored area; and, c) a flexible convex curved surface integral with said plate and extending upwardly therefrom approximately directly under said drive arm within said scored area, said convex surface defining means for application of downward finger pressure for inverting said convex surface to enable said drive arm to be pivoted downward to automatically raise said lift arm above said plate for easy grasping by a finger and subsequent pivoting upwardly to drive said drive arm down against said scored area to disengage and fold said scored area from said lid to provide a pour opening for said lid.

2. The improved pop-top can lid of claim 1 wherein said raised convex surface upwardly biases said drive arm to force said lift arm down against the upper surface of said plate to prevent rattling of said tab and to facilitate stacking of said lid with a plurality of like lids.

3. The improved pop-top can lid of claim 1 wherein said drive arm is angled upwardly of said lift arm so as to generally conform to the upward curvature of said raised convex surface.

4. The improved pop-top can lid of claim 1 wherein said plate is generally circular, wherein said rim is raised above the upper surface of said plate, and wherein said lift arm is longer than said drive arm.

5. The improved pop-top can lid of claim 1 wherein said drive arm includes a striker bar at an end thereof opposite said pivot point and wherein said drive arm extends over only a medial portion of said scored area so as not to block the opening which results when said scored area is disengaged and folded down from said plate by said drive arm.

6. The improved pop-top can lid of claim 1 wherein said plate and lift tab are metal and wherein said lift tab defines a finger-receiving opening.

* * * * *